United States Patent [19]

Desmond

[11] Patent Number: 4,582,247

[45] Date of Patent: Apr. 15, 1986

[54] ROUNDED CORNER LOCKING CARTON LID

[75] Inventor: John D. Desmond, Philadelphia, Pa.

[73] Assignee: Container Corporation of America, Chicago, Ill.

[21] Appl. No.: 739,710

[22] Filed: May 31, 1985

[51] Int. Cl.[4] ..... B65D 5/24

[52] U.S. Cl. ..... 229/31 R; 229/32; 229/43; 229/3.1

[58] Field of Search ..... 229/31 R, 32, 43, 3.1

[56] References Cited

U.S. PATENT DOCUMENTS

| | | | |
|---|---|---|---|
| 3,924,013 | 12/1975 | Kane | 229/31 R |
| 4,014,496 | 3/1977 | Christensson | 229/31 R |
| 4,199,097 | 4/1980 | Christensson | 229/31 R |
| 4,208,007 | 6/1980 | Bamburg et al. | 229/31 R |

FOREIGN PATENT DOCUMENTS

| | | | |
|---|---|---|---|
| 1417025 | 12/1975 | United Kingdom | 229/31 |

*Primary Examiner*—Joseph Man-Fu Moy

*Attorney, Agent, or Firm*—Richard W. Carpenter

[57] ABSTRACT

A generally liquid-tight, one-piece, paperboard carton lid having straight side and end walls joined to each other by rounded corner walls.

6 Claims, 7 Drawing Figures

ROUNDED CORNER LOCKING CARTON LID

BACKGROUND OF THE INVENTION

1. Field of the Invention

This invention relates generally to folding carton lids, and more particularly to a liquid-tight, locking, paperboard carton lid having rounded corners for use with a carton of similar shape.

2. Description of the Prior Art

Applicant is unaware of any prior art patent that discloses a one-piece, liquid-tight, paperboard carton lid having an absolutely flat top wall with straight side and end walls and rounded corner walls joined to the top wall by a gusset arrangement formed in the manner of the present invention.

SUMMARY OF THE INVENTION

It is an object of the present invention to provide a one-piece paperboard carton lid having straight side and end walls joined to each other by rounded corner walls.

A more specific object of the invention is the provision, in a carton of the type described, of a liquid-tight, rounded corner construction.

Another specific object of the invention is the provision of a unique gusset arrangement for joining the corner edges of a carton top wall to the upper edges of carton side and corner walls.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
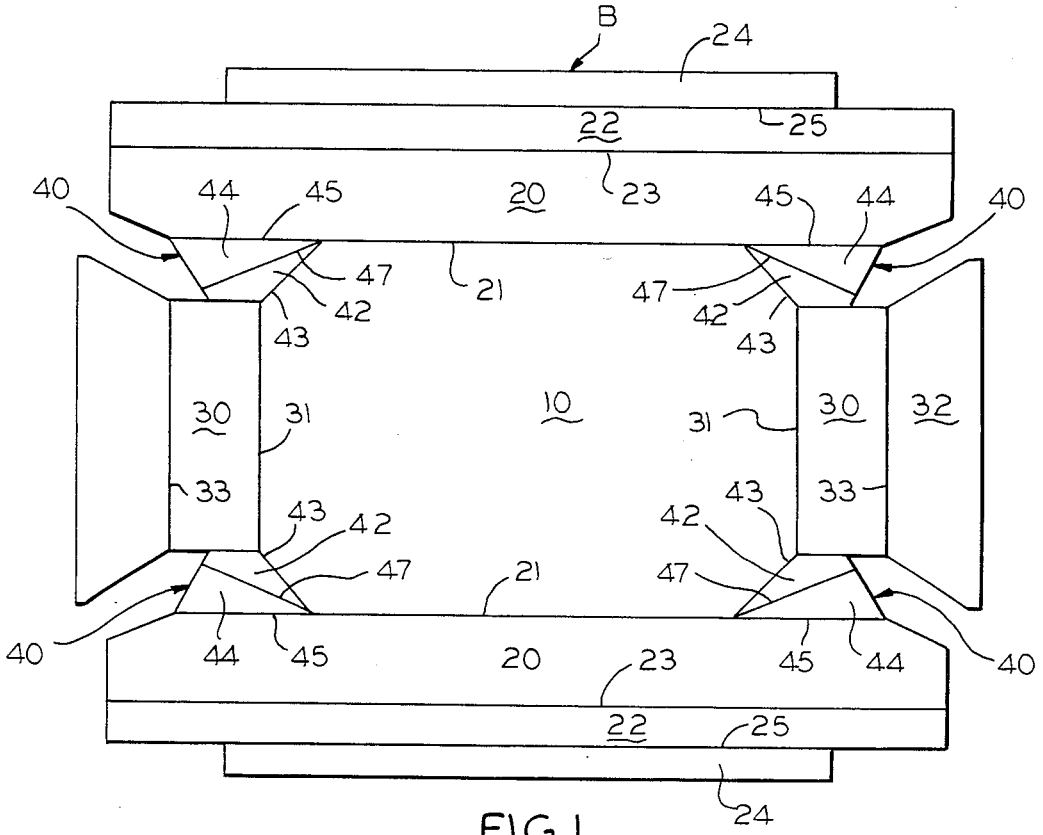
FIG. 1 is a top plan view of a blank of foldable sheet material from which the carton lid illustrated in FIGS. 5 and 6 may be formed.
Figure 5:
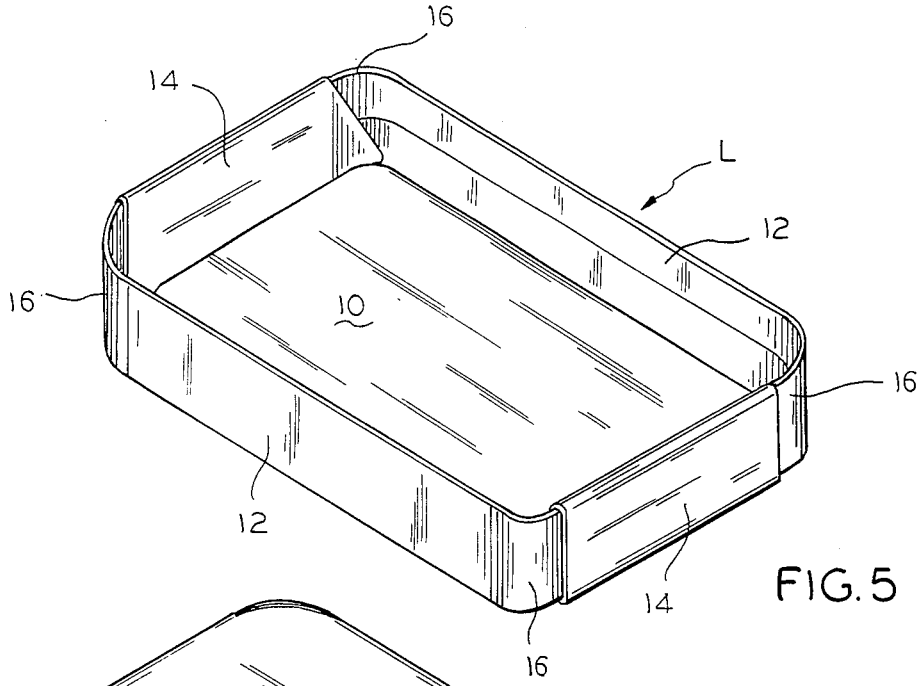
FIGS. 5 and 6 are perspective views of a completely erected carton lid embodying features of the invention, as seen from the inside and outside, respectively.
Figure 6:
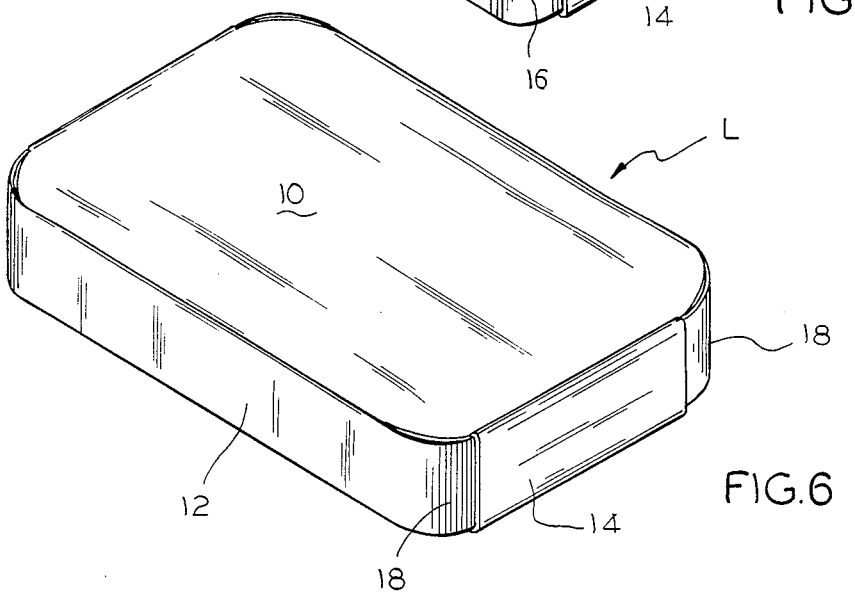

Referring now to the drawings for a better understanding of the invention, it will be seen that the rounded corner, locking carton lid, indicated generally at L in FIGS. 5 and 6, may be formed from the unitary blank B of foldable sheet material, such as coated paperboard, illustrated in FIG. 1.

The lid L, as best seen in FIGS. 3–6, includes a flat top wall panel 10, having side walls 12, and end walls 14, depending therefrom. Side walls 12, include center portions **12*a*, and end portions 12*b*, which are curved around from the center portions 12*a* at the end of the carton, to provide rounded corner walls 16**.

Each of the side walls 12 includes a side wall panel 20, foldably joined at its upper edge along a fold line 21, to related side edge of top wall panel 10.

Each side wall also includes a lock flange first panel 22, foldably joined along a fold line 23 to an outer edge of side wall panel 20, and a lock flange second panel 24, foldably joined along a fold line 25 to an outer edge of lock flange first panel 22.

It will be seen that each of the end walls 14 includes an outer panel 30, which is foldably joined along a fold line 31 to a related end edge of top wall panel 10, and an inner panel 32, which is foldably joined along a fold line 33 to an outer edge of related outer panel 30.

In order to provide the unique, leak-proof, rounded corners for the carton lid, the diagonally angled corner edges of top wall panel 10 are connected to the upper edges of the side wall end portions **12*b* by means of novel corner gussets 40**.

Each of the gussets 40 includes a pair of generally triangular first and second sections 42 and 44, respectively, which are foldably joined to each other on a fold line 47.

First section 42 is foldably joined to the top wall panel on a fold line 43, and second section 44 is foldably joined on a fold line 45 to the related end portion of side wall panel 20. It will be noted that fold line 45 is an extension of fold line line 21, which joins the side wall outer panel 20 to top wall panel 10.

Figure 3:
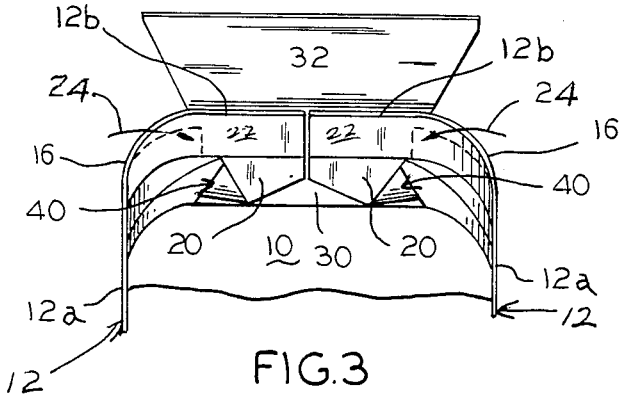
FIGS. 3 and 4 are fragmentary perspective views of the structure illustrated in FIG. 2, but illustrating two stages in the formation of the carton lid from the blank illustrated in FIGS. 1 and 2.
Figure 4:
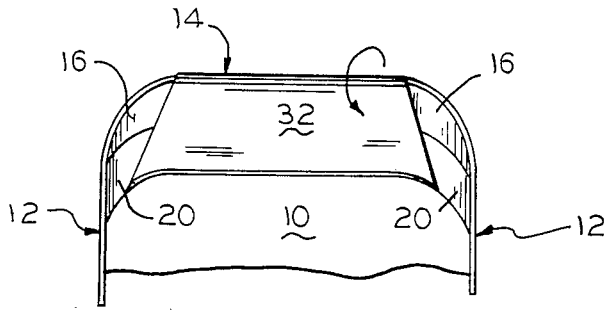

The fold lines defining each corner gusset 40 are formed by embossing or debossing to facilitate folding of blank B in order to form the carton lid L, as best seen in FIGS. 3 and 4.

Fold line 43, which joins the gusset first section 42 to the top wall panel 10 is shown as a diagonal or angled line between the related side and end edges of top wall panel 10. This may be a straight line or may have two sections which form an angle with each other or may be curved slightly. When the side walls are folded downwardly from the top wall panel angled corner edges, and the end portions are folded inwardly from the center portions, the sections of each gusset lie in face-to-face relation with each other against the inner side of the related side wall end portion, and the side wall end portions form curved corner walls 16.

Figure 2:
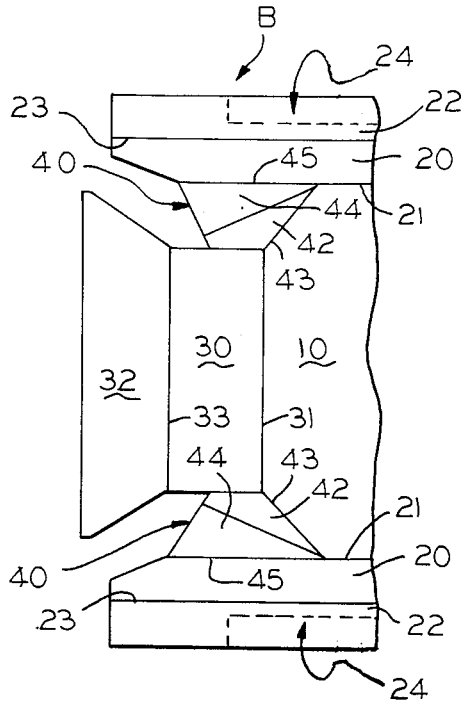
FIG. 2 is a top plan view of one end of the blank illustrated in FIG. 1, with portions of the structure folded into a position different from that shown in FIG. 1.

In erecting the carton, before side wall panels 20 are folded downwardly from the top wall panel, the locking flange is first formed. This is accomplished by folding flange second panel 24 inwardly 180 degrees against the inner surface of flange first panel 22, as illustrated in FIG. 2. Flange first panel 22 is then folded 180 degrees inwardly against the inner surface of related side wall panel 20. The side wall panels 20 can then be folded downwardly 90 degrees from top wall panel 10.

At this point the end portions **12*b* of the side wall panels are folded inwardly under the corner and end edges of top wall panel 10, with the ends of the related end portions in substantially abutting relationship, as shown in FIG. 3**.

End wall panels 30 are then folded downwardly from the top wall panel, and the end wall inner panels are folded back upwardly to enclose the end portions of the side wall panels, as illustrated in FIGS. 3 and 4. Inner end panel 32 is preferably adhesively secured to the end portions of the side wall panels to complete the formation of the carton lid.

Thus, it will be seen that the novel construction provides a unique, rounded corner, locking carton lid having a flange adapted to interlock with a related flange on a folding carton having a similar contour.

Figure 7:
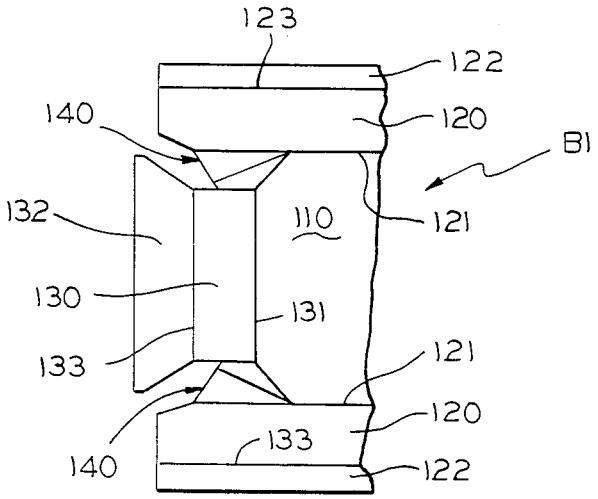
FIG. 7 is a fragmentary view similar to FIG. 1, but illustrating a slightly modified form of the invention.

Turning now to FIG. 7 of the drawings, it will be seen that a slightly modified form of the invention is shown. In this embodiment certain parts of the structure which correspond to those the previous embodiment have been identified by related numerals. In this embodiment, the flange consists of only one panel, 122, which is foldably joined along fold line 123 to the lower edge of side wall panel 120.

This lid functions in the same manner as that of the first embodiment, except that the flange is one ply thinner than the flange of the previous embodiment.

What is claimed is:

1. A generally liquid tight carton lid having straight side and end walls joined to each other by rounded corner walls, said lid being formed from a unitary blank of foldable sheet material, such as coated paperboard, and comprising:

(a) a top wall panel having pairs of opposed parallel straight side and end edges joined to each other by angled corner edges;

(b) a pair of opposed side walls having center portions joined to respective side edges of said top wall panel and extending downwardly therefrom;

(c) said side walls having end portions extending a substantial distance beyond said center portions and folded inwardly to lie under said top wall panel corner edges and end edges.

(d) a pair of opposed end walls joined to respective end edges of said top wall panel and extending downwardly therefrom, and each overlapping and enclosing a pair of related side wall end portions;

(e). each of said end walls including:

(i) an outer panel foldably joined at its upper edge to an end edge of said top wall panel;

(ii) an inner panel foldably joined at a lower edge to a lower edge of said outer panel and folded inwardly and upwardly therefrom and secured to said related side wall end portions;

(f) each of said side walls including:

(i) a panel foldably joined at an upper edge to a side edge of said top wall panel;

(ii) a flange first panel foldably joined to a lower edge of said outer panel and folded inwardly and upwardly therefrom;

(iii) an inner flange second panel foldably joined to an upper edge of said flange first panel and folded downwardly therefrom between said side wall panel and said flange first section;

(g) each corner edge of said top wall panel being joined to an upper edge of a related side wall panel end portion by a gusset member which includes a pair of generally triangular first and second sections foldably joined to each other;

(h) said first gusset section being foldably joined to said top wall panel corner edge;

(i) said second section being foldably joined to said related side wall panel end portion upper edge along a fold line which is an extension of a fold line joining said side wall panel center portion to said top wall panel side edge.

2. A generally liquid tight carton lid having straight side and end walls joined to each other by rounded corner walls, said lid being formed from a unitary blank of foldable sheet material, such as coated paperboard, and comprising:

(a) a top wall panel having pairs of opposed parallel straight side and end edges joined to each other by angled corner edges;

(b) a pair of opposed side walls having center portions joined to respective side edges of said top wall panel and extending downwardly therefrom;

(c) said side walls having end portions extending a substantial distance beyond said center portions and folded inwardly to lie said under said top wall panel corner edges and end edges;

(d) a pair of opposed end walls joined to respective end edges of said top wall panel and extending downwardly therefrom, and each enclosing a pair of related side wall end portions;

(e) each of said end walls including:

(i) an outer panel foldably joined at its upper edge to an end edge of said top wall panel;

(ii) an inner panel foldably joined at a lower edge to a lower edge of said outer panel and folded inwardly and upwardly therefrom and secured to said related side wall end portions;

(f) each of said side walls including:

(i) a panel foldably joined at an upper edge to a side edge of said top wall panel;

(ii) a flange panel foldably joined to a lower edge of said outer panel and folded inwardly inwardly and upwardly therefrom;

(g) each corner edge of said top wall panel being joined to an upper edge of a related side wall panel end portion by a gusset member which includes a pair of generally triangular first and second sections foldably joined to each other;

(h) said first gusset section being foldably joined to said top wall panel corner edge;

(i) said second section being foldably joined to said related side wall panel end portion upper edge along a fold line which is an extension of a fold line joining said side wall panel center portion to said top wall panel side edge.

3. A generally liquid tight carton lid having straight side and end walls joined to each other by rounded corner walls, said lid being formed from a unitary blank of foldable sheet material, such as coated paperboard, and comprising:

(a) a top wall panel having pairs of opposed parallel straight side and end edges joined to each other by corner edges;

(b) a pair of opposed side walls having center portions joined to respective side edges of said top wall panel and extending downwardly therefrom;

(c) said side walls having end portions extending a substantial distance beyond said center portions and folded around under said top wall panel corner edges and end edges;

(d) a pair of opposed end walls joined to respective end edges of said top wall panel and extending downwardly therefrom, and each overlapping and enclosing a pair of related side wall end portions;

(e) each of said end walls including:

(i) an outer panel foldably joined at its upper edge to an end edge of said top wall panel;

(ii) an inner panel foldably joined at a lower edge to a lower edge of said outer panel and folded inwardly and upwardly therefrom and secured to said related side wall end portions;

(f) each of said side walls including a panel foldably joined at an upper edge to a side edge of said top wall panel;

(g) each corner edge of said top wall panel being joined to an upper edge of a related side wall panel end portion by a gusset member which includes a pair of generally triangular first and second sections foldably joined to each other;

(h) said first gusset section being foldably joined to said topwall panel corner edge;

(i) said second section being foldably joined to said related side wall panel end portion upper edge along a fold line which is an extension of a fold line joining said side wall panel center portion to said top wall panel side edge.

4. A lid according to claim 3, wherein each of said end wall inner panels is generally trapezoidal in shape with a free upper edge of a greater length than that of the lower edge thereof.

5. A lid according to claim 3, wherein said side wall end portions are disposed in substantially abutting relation.

6. A unitary blank of foldable sheet material, such as coated paperboard, which is cut and scored to provide a generally liquid-tight, rounded corner carton lid, said blank comprising:

(a) a generally rectangular top wall panel having pairs of opposed straight, parallel side and end edges joined to each other at the corners of the blank by angled corner edges;

(b) generally rectangular end wall outer panels foldably joined to opposite end edges of said top wall panel and having a width less than that of said top wall panel;

(c) generally trapezoidal end wall inner panels foldably joined to outer edges of respective end wall outer panels;

(d) side wall outer panels having center portions of a length less than the length of said top wall panel and being foldably joined to opposite side edges of said top wall panel;

(e) said side wall panels having end portions, integral with said center portions, extending a substantial distance beyond the end edges of said top wall panel;

(f) said side wall end portions being joined to said top wall panel corner edges by gusset members each of which include:

(i) a pair of generally triangular first and second sections foldably joined to each other;

(ii) said first section being foldably joined to a corner edge of said top wall panel;

(iii) said second section being foldably joined to a related side wall panel end portion along a fold line which is an extension of a fold line joining the center section of said side wall panel to said top wall panel side edge.

* * * * *